US006769968B2

(12) United States Patent
So

(10) Patent No.: US 6,769,968 B2
(45) Date of Patent: Aug. 3, 2004

(54) INTERCHANGEABLE CONDITIONING DISK APPARATUS

(75) Inventor: Joseph K. So, Newark, DE (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 39 days.

(21) Appl. No.: 10/109,813

(22) Filed: Mar. 29, 2002

(65) Prior Publication Data

US 2003/0186627 A1 Oct. 2, 2003

(51) Int. Cl.[7] ..... B24B 1/00
(52) U.S. Cl. ..... 451/56; 451/443
(58) Field of Search ..... 451/56, 443, 444, 451/72, 285, 286, 287, 288, 289, 296

(56) References Cited

U.S. PATENT DOCUMENTS

| | | | | |
|---|---|---|---|---|
| 5,738,574 A | | 4/1998 | Tolles et al. | |
| 5,782,675 A | * | 7/1998 | Southwick | 451/56 |
| 5,904,615 A | * | 5/1999 | Jeong et al. | 451/443 |
| 5,975,994 A | * | 11/1999 | Sandhu et al. | 451/56 |
| 6,361,413 B1 | * | 3/2002 | Skrovan | 451/56 |
| 6,368,186 B1 | * | 4/2002 | Wu | 451/28 |

* cited by examiner

*Primary Examiner*—Dung Van Nguyen
(74) *Attorney, Agent, or Firm*—Gerald K. Kita; Edwin Oh

(57) ABSTRACT

A conditioning apparatus and method for conditioning a polish pad. The conditioning apparatus has a movable conditioning arm with a disk mounting apparatus, a plurality of interchangeable conditioning disks, a disk housing or multiple disk stations capable of holding the plurality of interchangeable conditioning disks and a controller for directing and controlling the movement of said conditioning arm.

18 Claims, 3 Drawing Sheets

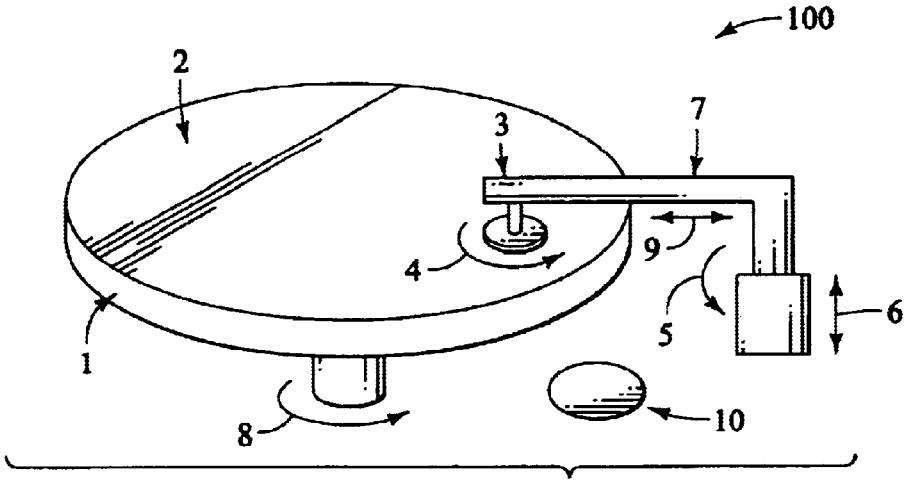
FIG. 1
PRIOR ART
FIG. 2
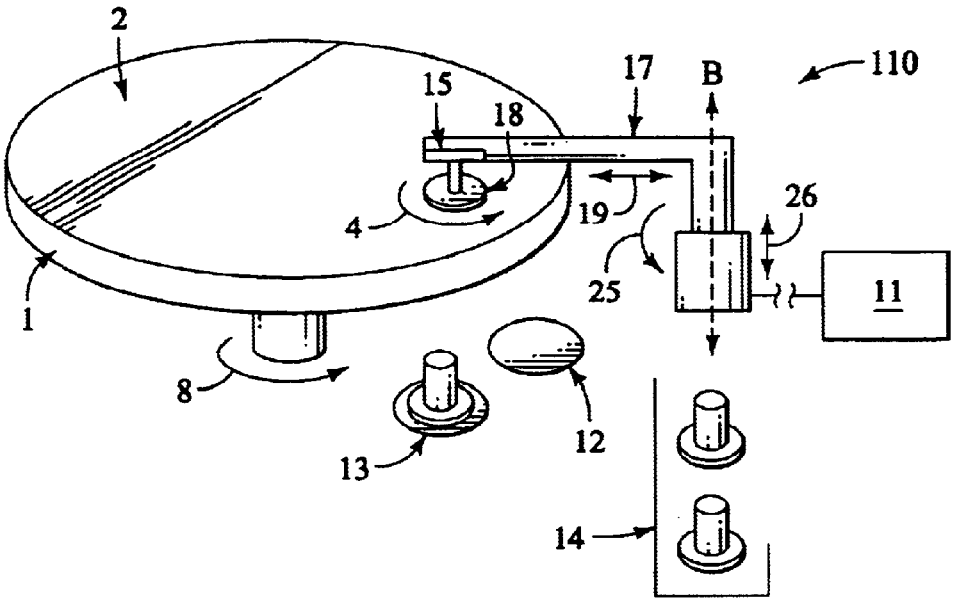

INTERCHANGEABLE CONDITIONING DISK APPARATUS

FIELD OF THE INVENTION

The present invention relates, in general, to a system and method for cleaning and conditioning polish pads used to polish silicon wafers and semiconductors and, more particularly, to pad cleaning during polishing and pad conditioning and cleaning after a wafer has been polished with a polishing composition.

BACKGROUND

Silicon wafers are commonly used as a base on which multilevel integrated circuits are fabricated. Integrated circuits on semiconductor wafers are manufactured with a layer of an insulating layer or semi-conductive or conductive metal substrate layer. This layer can be a dielectric, such as, silica including $SiO_2$ and TEOS. It can also be a low K dielectric, poly-silicon or metal such as tungsten, aluminum, copper and platinum.

A series of deposition and etch steps are required to form a multi-level pattern on a semiconductor wafer. Silicon wafers for the semiconductor industry must possess a high degree of surface perfection before they can be useful in the device fabrication process. A non-planar silicon wafer surface during the manufacturing process causes a focusing problem for photolithography and results in lower yield and decreases performance of the semiconductor device.

A polishing system known as CMP, referred to as either or both, chemical-mechanical planarization and chemical-mechanical polishing of non-planar wafer is utilized in a conventional process. The CMP process is used to planarize the insulating layer on a silicon wafer. A CMP process can be used for an insulating layer whether it be a dielectric material, conductive metal or semi-conductive layer. The CMP process utilizes different polishing pads and polishing compositions or slurries. Further details of CMP polishing features and operation of a polishing apparatus for a CMP process may be found in U.S. Pat. No. 5,738,574, which is incorporated by reference.

In a CMP process, the wafer is pressed against a moving polishing pad. In a CMP process, the silicon wafer, is bathed or rinsed in a polishing slurry in conjunction with an elastomeric pad which is pressed against the substrate and rotated such that the slurry particles are pressed against the substrate under load. The lateral motion of the pad causes the slurry particles to move across the substrate surface, resulting in wear, or volumetric removal of the substrate surface. Ideally, this process results in the selective erosion of projecting surface features so that when the process is completed a plane surface is produced down to the finest level of detail.

However, the CMP process generates heat due to chemical reaction and mechanical friction, which degrades the surface topography of the pad. Also, by-product of the slurry from wafer-substrate reaction produces slurry waste, which accumulates on the pad or within the pad groove and prevents even distribution of fresh slurry and degrades pad asperities. The combination of the above reactions can produce glazing of the pad. Glazing is referred to a surface phenomenon which occurs when the pad temperature during CMP is at or exceeds the pad glass transition temperature and deforms the pad material and traps slurry by-products. These slurry by-products become partially or fully fused into the surface of the pad. Glazing decreases pad asperity and increases wafer non-uniformity and defects on the wafer.

The conventional CMP process uses a conditioning apparatus, as disclosed in U.S. Pat. No. 6,217,429 or similar device using a diamond or abrasive material on a disk in contact with the polish pad to remove glaze material and by-product of CMP waste. On a buffing pad or softer pad, a brush is used instead of a diamond disk. Deionized (DI) water is normally used during pad conditioning to help lubricate the pad and to remove debris from the pad. A high-pressure DI sprayer is sometimes used to speed up the cleaning process. For metal CMP and especially for copper CMP, cleaning solution is used to speed up the cleaning and decontamination of slurry by-products from the surface of the pad.

It is known that to perform pad conditioning with a diamond disk and clean the pad groove with brushes at the same time, two separate conditioning arms or a conditioning arm with two different disks are necessary. For example, Tolles et al. (U.S. Pat. No. 5,738,574) discloses a conditioning apparatus with a conditioning arm with multiple disks and multiple polishing stations. However, having separate conditioning arms or multiple disks increases the cost of the polishing apparatus. Accordingly, it has been desired to develop a method and apparatus for polishing a semiconductor wafer that addresses the problems above and reduces glazing and the steps and costs of polishing semiconductor wafers.

BRIEF SUMMARY

The present invention provides a conditioning apparatus with interchangeable disks with different conditioning materials to condition a polishing pad. To condition the pad, conditioning disks with abrasive material, brushes, scrubbing material can be interchanged during polishing.

In one aspect the invention includes a conditioning apparatus for conditioning a polish pad. The conditioning apparatus includes a movable conditioning arm with a disk mounting apparatus, a plurality of interchangeable conditioning disks, a disk housing capable of holding the plurality of interchangeable conditioning disks, and a controller for directing and controlling the movement of the condition arm.

In a second aspect the invention includes a conditioning apparatus that includes a movable conditioning arm with a locking module for securely holding an interchangeable disk. The interchangeable disk has a mounting sprocket which mates with said locking module. The conditioning apparatus has a plurality of disk stations positioned so that the locking module of the conditioning arm can be positioned directly over any of the plurality of disk stations. A plurality of the interchangeable disks are located on the disk stations and a controller is used for directing and controlling the movement of the condition arm.

In a third aspect the invention includes an interchangeable conditioning disk for conditioning a polishing pad that has one or more conditioning materials on a surface of the disk and a mounting sprocket on a surface opposite the surface with the conditioning material. The mounting sprocket mates with a locking module of a conditioning arm.

In a fourth aspect the invention includes a method of conditioning a polishing pad which includes the steps of: a) providing a conditioning disk apparatus having a movable conditioning arm with a disk mounting apparatus and a plurality of interchangeable conditioning disks, wherein each of the interchangeable conditioning disks have one or more conditioning materials on a surface of the disks; b) placing a polishing pad on a top surface of a platen; c)

mounting one of the conditioning disks on the conditioning arm; d) moving the conditioning arm and conditioning disk to a position over the polishing pad; e) conditioning the polishing pad by rotating the conditioning disk and providing a downward force on the disk and polishing pad; f) moving said conditioning arm to a position over an empty disk station; g) releasing said conditioning disk on said empty disk station; h) mounting another one of the plurality of interchangeable conditioning disks on the conditioning arm; and i) repeating steps d) through h) until said polishing pad has the desired properties.

Other objects, features and advantages of the present invention will become apparent from the following detailed description. It should be understood, however, that the detailed description and the specific examples, while indicating embodiments of the invention, are given by way of illustration only, the invention being defined only by the claims following this detailed description.

BRIEF DESCRIPTION OF SEVERAL VIEWS OF THE DRAWINGS

FIG. 1 (Prior Art) is a perspective view of a conventional conditioning disk and cleaning brush from chemical mechanical polishing;

FIG. 2 is a perspective view in accordance with one embodiment of an interchangeable conditioning system of the present invention;

DETAILED DESCRIPTION OF THE PREFERRED EMBODIMENT

Figure 3:
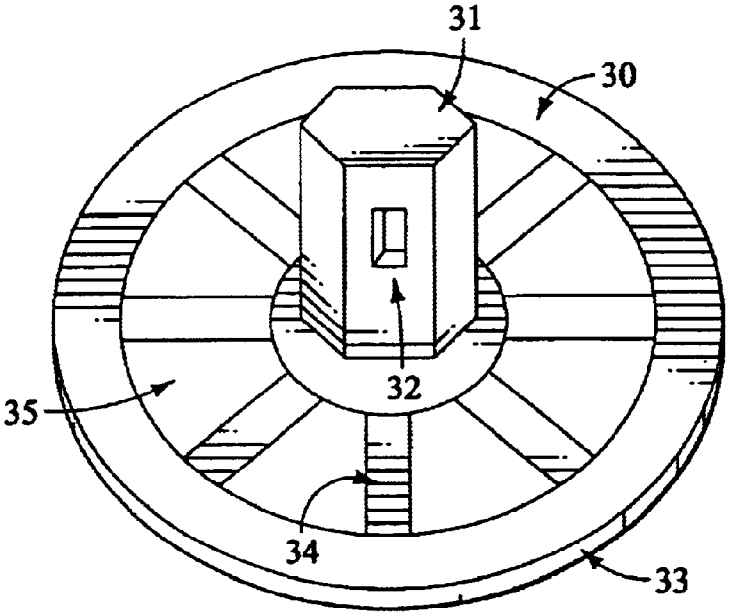
FIG. 3 is a perspective view of an interchangeable disk from the conditioning system illustrated in FIG. 2.

FIG. 1 illustrates a conventional conditioning apparatus 100 used in rotary polishing. The conditioning apparatus 100 has a main platen 1 that rotates in counterclockwise direction 8 with a polish pad 2, which is placed on top of the platen 1. The conditioning apparatus has a conditioning arm 7 with a fixed conditioning disk 3. The conditioning arm 7 has mechanical means for rotating disk 3 in preferably a counterclockwise direction 4. The conditioning arm also has means for providing longitudinal movement 9, arm oscillation movement 5 and provides a downward force 6 which is applied to disk 3. When the conditioning apparatus is in standby mode, the conditioning arm 7 moves off the platen 1 and is positioned above the disk cleaning station 10. To change the fixed conditioning disk 3, the operator must stop the polisher and manually remove the fixed conditioning disk. The conventional conditioning system illustrated in FIG. 1 lacks ability to change the conditioning disk while the polisher is running.

FIG. 2 illustrates one embodiment of a conditioning apparatus 110 with interchangeable conditioning arm mounting 15 and multiple disk cleaning stations 12, 13, 14, of the present invention. Although there are three disk stations in the embodiment illustrated in FIG. 2, it is intended that conditioning system 110 has any plurality of disk stations or a single stack disk station 14 that can house more than one conditioning disk. The conditioning apparatus 110 has a main platen 1 that rotates in counterclockwise direction 8 with a polish pad 2, which is placed on top of the platen 1. The conditioning apparatus has a conditioning arm 17 with an interchangeable conditioning disk 18. The conditioning arm 17 has mechanical means for rotating disk 18 in preferably a counterclockwise direction 4. The conditioning arm 17 has means for movement in the longitudinal direction 19. Conditioning arm 17 also has means for rotational movement 25 about axis B and vertical movement 26. The rotational movement 25, vertical movement 26 and longitudinal movement 19 can occur independently or simultaneously, thereby giving conditioning arm 17 the maximum freedom of movement.

The system control is through interface 11 which receives conditioning parameters from the CMP polisher. By controlling rotational movement 25, vertical movement 26 and longitudinal movement 19, the conditioning arm 17 can move from a position on platen 1 to a position directly over any of disk cleaning stations 12, 13, and 14. The conditioning arm is positioned so that it is capable of reaching the platen 1 and all of the multiple disk stations 12, 13, 14. To interchange conditioning disks, conditioning arm 17 moves from a position over platen 1 to a position over an empty disc station 12. Conditioning arm 17 then releases a conditioning disk 18 on the empty disc station, moves to either disk station 13 or 14, picks up another disk and moves back to a position over the platen 1 for further conditioning.

For ease of interchanging the conditioning disk, a positioner or state is designed to provide adjustment in one or more degrees of freedom. A transition positioner (not shown) provides longitudinal motion 19, a height-adjustable positioner (not shown) provides linear vertical adjustment 26 and a rotary positioner (not shown) provides pure angular adjustment 25 to align, center and level the conditioning arm 17 while interchanging the conditioning disk. For automated positioners, like those incorporated in the conditioning arm apparatus, the position resolution is defined mechanically. Resolution, straightness of travel, angular deviation and eccentricity or runout arc measurements that reveal the performance limitations of a positioner in a conditioning arm. Angular errors create linear errors and unintended linear travel along the x-axis results in error along the y-axis. The unintended errors increase as the length of the conditioning arm is increased. It is therefore preferable to keep the conditioning arm 17 as short as possible. One way of doing this is by keeping the disk stations 12, 13 and 14 in close proximity to the polish platen 1.

A stack disk station 14 is preferred for an interchangeable disk system for a rotary, orbital and linear polisher. A stack disk station 14 has more than one conditioning disk on the station. The movement of the conditioning arm 17 required for a conditioning process is preferably programmed into the controller 11 which uses data from the positioners to guide the movement of the conditioning arm 17. Determining the characteristics of the interchangeable disk system and matching those characteristics to the performance level of available positioners can eliminate many of the variable error associated with movement required to interchange a conditioning disk.

Figure 4:
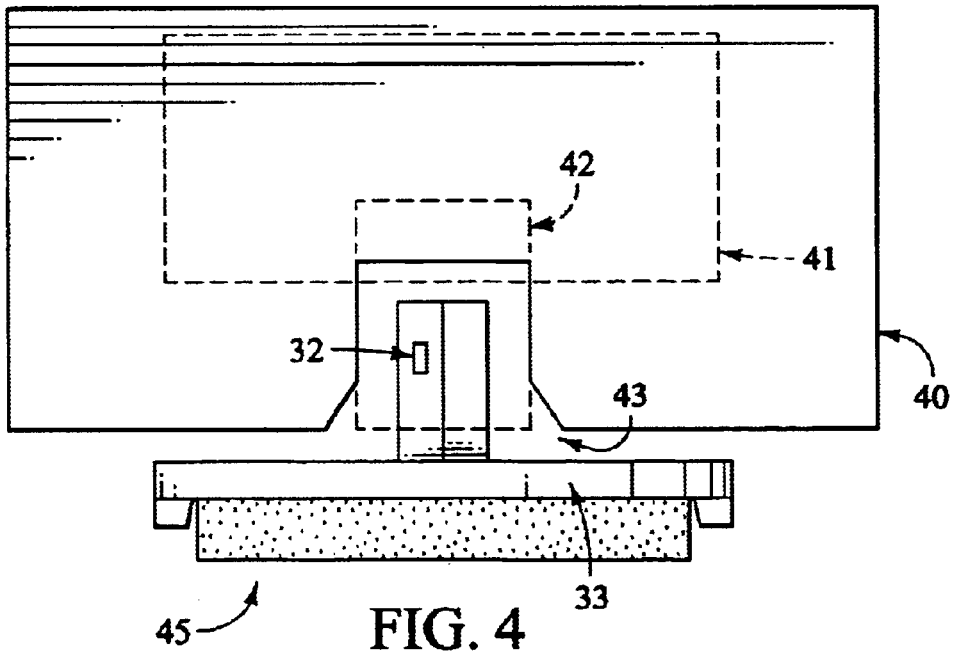
FIG. 4 is a side view of the interchangeable disk of FIG. 3.
Figure 5:
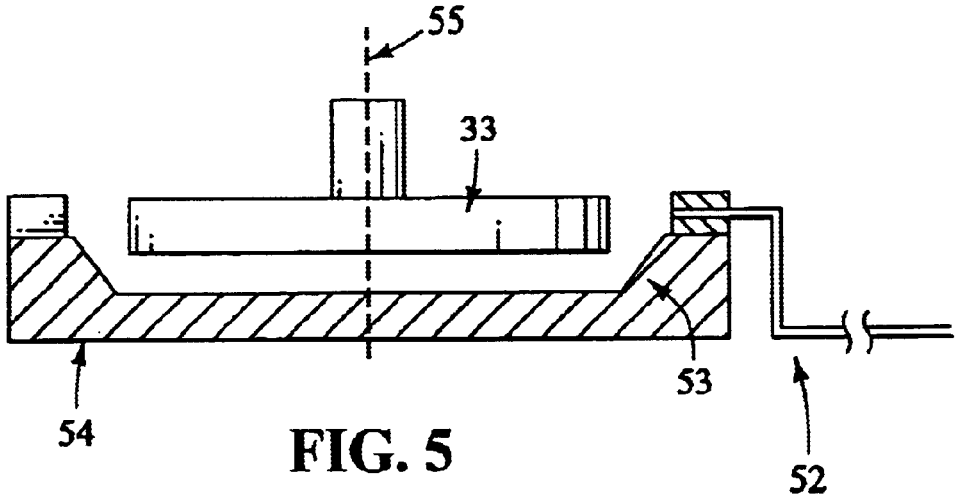
FIG. 5 is a perspective view in accordance with one embodiment of a self-aligning disk station of the present invention.
Figure 5A:
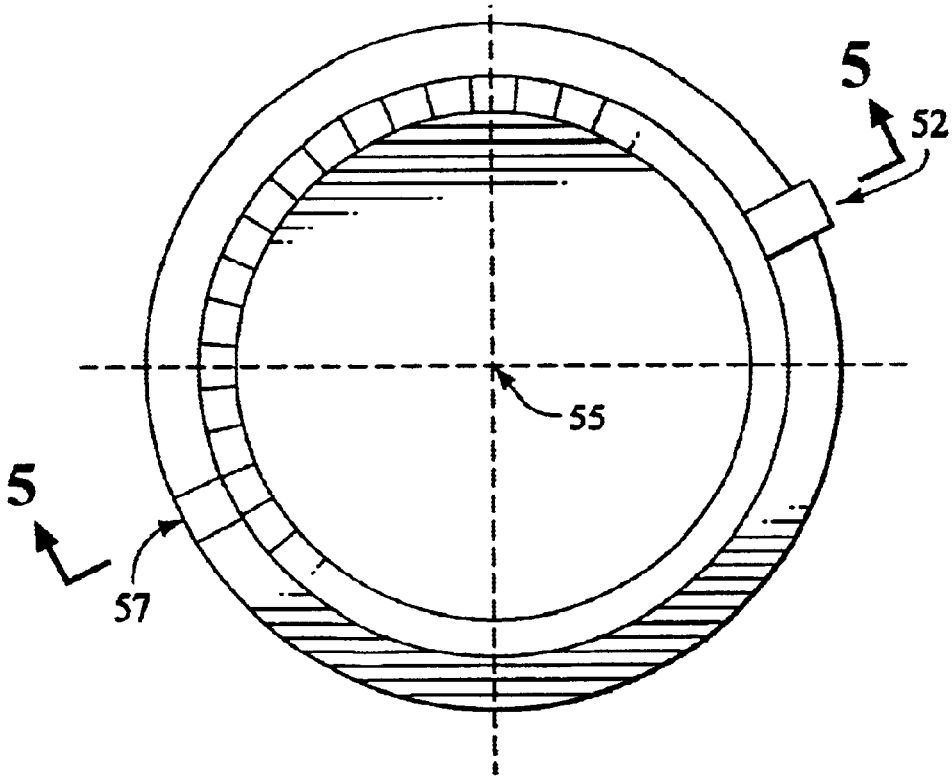
FIG. 5A is a partial top plan view of FIG. 5.

FIGS. 3, 4, 5, and 5A illustrate another embodiment of an interchangeable conditioning disk apparatus of the present invention. The conditioning disk 33 is mounted on a disk ring 30, which is attached to a mounting sprocket 31 with locking pin 32. As illustrated in FIG. 4, conditioning arm 40 is aligned over the disk station and has a self-aligner 43 to guide the conditioning arm 40 in order to place mounting sprocket 31 in the center of locking module 42. The disk is locked by a locking pin 32 within the module and is rotated by a mechanical motor 41. The disk 33 has conditioning material 45 on a surface opposite the surface with the mounting sprocket 31. The conditioning material is preferably an abrasive material, a scrubbing material, brushes or any combination thereof.

To release the disk, the conditioning arm 40 returns to a position over the center of the disk station 54 and releases the disk. The disk is guided by a disk station self-aligner 53 and lowered to so that the center of disk is aligned with the center position 55 of the station. Cleaning solution is injected through the nozzle 52 and overflows out of the station through an opening 57. The injection rate of the cleaning solution is controlled by an interface controller 11.

A conditioning arm with an interchangeable conditioning disk apparatus capable of using more than one type of conditioning disk is effective in cleaning and maintaining the structural integrity of the conditioning CMP pad when using conventional abrasive slurry and especially for a metal CMP slurry process. Reactive liquid slurry used in copper CMP generates insoluble copper-benzotriazole (Cu-BTA) compounds during polish. This insoluble by-product sticks to the surface of the pad and fills the polish pad groove during polishing. Also, the accumulation of the insoluble by-product disturbs the normal slurry flow pattern, especially the area where the wafer contacts the polish pad and changes the removal rate profile. Conventional systems are insufficient at stopping this phenomenon, A conventional diamond grid disk only conditions the surface and cannot remove by-product within the polish pad groove. Brush conditioners remove the slurry by-product within the groove but are not effective to condition the pad surface. A high pressure DI water spray is ineffective to remove sticky Cu-BTS and unable to dissolve insoluble materials.

During copper CMP using reactive liquid slurry, removal rate of copper decreases versus polishing time due to Cu-BTA by by-product buildup on the surface and within the pad groove. Using an in-situ condition during polishing with a diamond conditioner does not efficiently remove the insoluble by-product within the pad groove. Use of a brush or a scrubbing material removes the insoluble by-product more efficiently than the diamond conditioners with in groove of the pad. The present invention address the cleaning problem associated with copper CMP by employing a conditioning arm with a mechanism to interchange conditioning disks. Thus conditioning disks with various conditioning materials may be interchanged for a particular application. Another option to clean the surface of the pad is with composite conditioning disks that have more than one type of conditioning material which are described in Rodel NOI-010028 and is incorporated by reference.

When cleaning solution is injected within the conditioning disk and agitated by rotating brushes, the insoluble Cu-BTA gets wet much faster and reacts to cleaning chemistry. The conventional nozzle dispenser position is outside of the conditioning disk and most of the cleaning solution does not go within the conditioning area due to the squeeze effect caused by compression of the conditioning disk against the polish pad due to downforce applied by the conditioning arm and centrifugal force caused by rotation of polishing platen during conditioning.

In another embodiment, the present invention provides a method for cleaning a polishing pad. When a new polish pad is installed on a platen 1, it is pre-conditioned. During pre-conditioning, contamination is removed during pad installation to remove manufacturing defects prior to polishing. For a polyurethane polish pad, like Rodel IC 1000, a diamond disk is used to break-in the pad. With the interchangeable conditioning disk system of the present invention, the conditioning arm picks up a diamond disk from one of the multiple disk stations 12, 13 or a stack disk station 14 and moves it to a conditioning position and rotates the diamond disk over the pad while applying a downward force on the disk to pre-condition the pad. A process engineer has the option to select various diamond sizes, shapes and densities to obtain a polish pad with the desired properties. Conventional conditioning systems use a fixed disk with a fixed diamond size, shape and density and, therefore, have no process option to change the conditioning disk during pad pre-conditioning.

After completing pad pre-conditioning, the conditioning arm interchanges the break-in disk with a polishing conditioning disk. Different abrasive sizes, densities and shapes can then be selected for use during polishing to obtain desired pad properties. Also, the capability to interchange conditioning disks offers more options for a process engineer to pick and choose the conditioning disk material and also extend the life of the conditioning disks, polish pad and improve overall polishing performance. When a copper CMP process calls for both abrasive and brush conditions during polish, the systems of the present invention can interchange the disk without having to manually stop the polisher and change the disks. Furthermore, the conditioning apparatus and conditioning disks of the present invention can perform both ex situ and in situ conditioning. Table I lists examples of various process options that are available with the present invention.

TABLE I

| Pad break-in | Ex-situ or In-situ segmented conditioning options |
|---|---|
| Diamond | Diamond only |
| Other abrasive material | Brush only |
| Brush | Scrubber only |
| Scrubbing material | Diamond/brush |
| Composite disk | Diamond/scrubber |
| Combination of above disks | Diamond/brush/scrubber Composite disks |

Another unique feature of an embodiment of the present invention is the ability to use a scrubbing disk in conjunction with the abrasive disk or brushes to remove the slurry by-product from the surface of the pad without conditioning. Scrubbing with a scrubbing disk removes debris of slurry by-products from the surface of the polish pad by using a non-abrasive material to induce friction or rubbing to transfer materials from the polish pad to scrubbing disk. The non-abrasive materials are not restricted to polyurethane and are not limited to thermoplastics or thermosets. A few examples of non-abrasive materials used in the scrubbing disk are micro-porous polymeric materials, porous polyurethane impregnated felts, closed cell polyurethane foams and solid polymers having macro and micro texture.

One advantage of using a scrubbing disk during polishing is that it removes the insoluble slurry by-product, but does not change polish pad performance. By removing slurry by-product without affecting the pad, removal rate and non-uniformity is maintained at desired levels throughout the polishing process. The scrubbing material does not remove or condition the polish pad and, thus, enhances the pad life compared to using only a conventional abrasive conditioning disk.

It will be understood that although the invention has been described and illustrated with reference to CMP and specially for copper CMP, it is not intended that the invention by limited to the illustrated embodiments. Those skilled in the art will recognize that modifications and variations may be made without departing from the spirit and the scope of the invention. For example, the invention describes a conditioning apparatus used in CMP on a rotary CMP tool, but the scope of this invention can be applied to linear, orbital and web-based CMP polishers as well. Therefore, the present invention is limited only by the claims appended hereto and the equivalents thereof.

What is claimed is:

1. A conditioning apparatus for conditioning a polish pad, comprising:

a) a movable conditioning arm with a disk mounting apparatus;

b) a plurality of interchangeable conditioning disks;

c) a disk housing capable of holding said plurality of interchangeable conditioning disks; and d) a controller for directing and controlling the movement of said conditioning arm.

2. The conditioning apparatus of claim 1, wherein said conditioning arm is capable of interchanging said disks from said disk mounting apparatus to said disk housing or from said disk housing to said disk mounting apparatus.

3. The conditioning apparatus of claim 1, wherein said plurality of interchangeable disks have one or more conditioning materials attached to a surface of said plurality of interchangeable disks.

4. The conditioning apparatus of claim 3, wherein said conditioning materials comprise an abrasive material, a scrubbing material, or brushes.

5. The conditioning apparatus of claim 4, wherein said abrasive material is a diamond.

6. The conditioning apparatus of claim 4, wherein said scrubbing materials are micro-porous polymeric material, polyurethane impregnated felts, polyurethane foams and solid polymers.

7. The conditioning apparatus of claim 1, wherein said conditioning apparatus is a rotary polisher.

8. The conditioning apparatus of claim 1, wherein said conditioning apparatus is a linear polisher or an orbital polisher.

9. The conditioning apparatus of claim 1, wherein said conditioning apparatus is used for ex situ conditioning and in situ conditioning.

10. The conditioning apparatus of claim 1 further comprising a dispenser for dispersing cleaning solution over said conditioning disk during conditioning.

11. A conditioning apparatus for conditioning a polishing pad comprising:

a) a movable conditioning arm with a locking module for securely holding an interchangeable disk with a mounting sprocket which mates with said locking module;

a) a plurality of disk stations positioned so that said locking module of said conditioning arm can be positioned directly over any of said plurality of disk stations;

c) a plurality of said interchangeable disks; and d) a controller for directing and controlling the movement of said conditioning arm.

12. The conditioning apparatus of claim 11, wherein said conditioning arm is capable of interchanging said disks from said locking module to said plurality of disk stations or from said plurality of disk stations to said locking module.

13. The conditioning apparatus of claim 11, wherein said plurality of interchangeable disks have one or more conditioning materials attached a surface of said plurality of interchangeable disks.

14. The conditioning apparatus of claim 13, wherein said conditioning materials comprise an abrasive material, a scrubbing material, or brushes.

15. The conditioning apparatus of claim 11 further comprising a dispenser for dispersing cleaning solution over said conditioning disk during conditioning.

16. The conditioning apparatus of claim 11, wherein said conditioning apparatus is a rotary polisher.

17. The conditioning apparatus of claim 11, wherein a locking pin locks said mounting sprocket with said locking module.

18. A method of conditioning a polishing pad comprising:

a) providing a conditioning disk apparatus comprising a movable conditioning arm with a disk mounting apparatus and a plurality of interchangeable conditioning disks, wherein each of said interchangeable conditioning disks have one or more conditioning materials on a surface of said disks;

b) placing a polishing pad on a top surface of a platen;

c) mounting one of said conditioning disks on said conditioning arm;

d) moving said conditioning arm and conditioning disk to a position over said polishing pad;

e) conditioning said polishing pad by rotating said conditioning disk and providing a downward force on said disk and polishing pad;

f) moving said conditioning arm to a position over an empty disk station;

g) releasing said conditioning disk on said empty disk station;

h) mounting another one of said plurality of interchangeable conditioning disks on said conditioning arm; and i) repeating steps d) through h) until said polishing pad has the desired properties.

* * * * *